US006112557A

United States Patent [19]

Crabtree

[11] Patent Number: 6,112,557

[45] Date of Patent: Sep. 5, 2000

[54] FLAT BED YARN MEASURING DEVICE AND METHOD

[75] Inventor: Charles R. Crabtree, Troy, N.C.

[73] Assignee: Carla A. Taylor, Asheboro, N.C.

[21] Appl. No.: 09/200,808

[22] Filed: Nov. 27, 1998

[51] Int. Cl.[7] ..... D04B 15/48

[52] U.S. Cl. ..... 66/125 R

[58] Field of Search ..... 66/125 R, 126 R, 66/127, 128, 129, 130, 126 A, 1 R; 364/470.12

[56] References Cited

U.S. PATENT DOCUMENTS

| | | | |
|---|---|---|---|
| 3,550,400 | 12/1970 | Peat et al. | 66/125 R |
| 3,690,123 | 9/1972 | Delair et al. | 66/125 R |
| 3,790,761 | 2/1974 | Crabtree | 66/125 R |
| 4,199,965 | 4/1980 | Wilson | 66/125 R |
| 4,574,598 | 3/1986 | Mattelie | 66/125 R |

FOREIGN PATENT DOCUMENTS

| | | | |
|---|---|---|---|
| 0027505 | 12/1981 | Japan | 66/126 R |

*Primary Examiner*—Danny Worrell

[57] ABSTRACT

An improvement to a flat bed knitting machine comprises a wheel positioned on the carrier of the flat bed knitting machine. The wheel turns as yarn passes thereover for knitting, thus allowing the wheel to measure the amount of yarn used. A series of magnets positioned on a bar beneath the needle bed send signals to a sensor attached to the carriage of the knitting machine as the sensor passes thereover. These signals instruct a logic circuit contained within a logic circuit control box to accept input from the wheel. The magnets are spaced apart by the distance of a known number of needles. Thus, the amount of yarn used can be divided by a known number of needles to arrive at a stitch size to help in the calibration of the flat bed knitting machine.

18 Claims, 4 Drawing Sheets

FLAT BED YARN MEASURING DEVICE AND METHOD

BACKGROUND OF THE INVENTION

1. Field of the Invention

This invention pertains to a device which accurately measures the yarn used by a flat bed knitting machine in order to measure stitch size.

2. Description of the Prior Art and Objectives of the Invention

The textile industry is an old and well established industry with many specialized machines and methods. One such machine is the flat bed knitting machine, which has existed in various forms for close to one hundred years. Presently, several variations are commercially available, such as the Z or XL series produced by NOVA of 1396 Walkup Avenue, Monroe, N.C. 28110. Other manufacturers include Protti, Stoll, and Universal. These machines, like other flat bed knitting machines are designed to efficiently knit collars for knit shirts such as those sold under the POLO® or IZOD® trademarks.

Such machines typically have one or two carriages, each with front and back camming mechanisms which drive needles positioned in a pair of needle tracks so as to knit a collar. Unfortunately, these carriages must be calibrated to provide identical stitch size in the collar. If one camming mechanism is out of calibration, i.e. making stitches of a size not uniform with the stitch size of the other camming mechanisms, the resulting collars created on the machine may unacceptably curl or otherwise fail to meet product requirements. In the past, stitch size has been visually examined by the technicians in order to approximate equivalent size. Additionally, stitch size determines how "loose" or "tight" a knitted fabric is, and is thus a quality control measurement.

In contrast to the flat bed industry, the circular knitting industry has long had a device which accurately measured the amount of yarn that was used to create a course around the knitting device. One such device is that disclosed in my U.S. Pat. No. 3,790,761 ('761) which uses a wand mounted wheel removably positioned proximate the yarn carrier to accurately measure yarn passing thereacross.

Important differences exist between the circular knitting machines and flat bed knitting machines. In contrast to a circular knitting machine which holds the carrier fixed relative to the needle bed, flat bed knitting machines move the carrier the length of the needle bed. Therefore, the wand mechanism of the '761 patent is an inappropriate device with which to measure the amount of yarn consumed since it would have to move with the carrier. Its hand-held nature would result in inaccurate readings. Likewise, in contrast to the circular knitting machines which maintain a relatively constant tension on the yarn being knit, flat bed knitting machines have widely varying tensions depending on the positions of the carriers.

Still further differentiating the two machines is the fact that in a circular knitting machine, there are always a fixed number of needles being used to form a course whereas in a flat bed machine, the number of needles may be varied to knit collars of different lengths. Thus, while techniques do exist which will measure stitch size, they are not easily adapted to the conventional flat bed knitting machine.

With the above concerns in mind, it is an objective of the present invention to provide a device which will accurately measure stitch size in a flat bed knitting machine.

It is a further objective of the present invention to provide a device which will help technicians make the stitch size of multiple carriages on a flat bed knitting machine uniform.

It is still a further objective of the present invention to provide a method of measuring stitch size on a flat bed knitting machine.

It is yet a further objective of the present invention to position a wheel to measure yarn on the carrier of a flat bed knitting machine.

It is another objective to provide an improvement on a flat bed knitting machine which uses magnets to effectively measure the amount of yarn used by a fixed number of needles.

These and other objectives and advantages will become readily apparent to those skilled in the art upon reference to the following detailed description and accompanying drawing figures.

SUMMARY OF THE INVENTION

The aforesaid objectives and advantages are realized by positioning a wheel substantially identical to that disclosed in U.S. Pat. No. 3,790,761, which is herein incorporated by reference, on the carrier of a flat bed knitting machine. Power is supplied to the wheel through a conventional four conductor cable and the output of the optical sensors within the wheel is sent by a second conductor within the cable to a logic circuit control box positioned preferably on the top of the carriage. On the back side of the flat bed knitting device, a bar is positioned proximate the path of the carriage. Three magnets are positioned on the bar. A sensor, comprising two Hall Effect switches, is positioned on a depending arm or flange of the carriage detects the magnets and instructs, via a second cable, the control logic circuit contained within the logic circuit control box to count or not. The three magnets mark a home, a start and a stop positions. The start and stop positions are preferably spaced by the length of one hundred needles on the needle bed of the knitting machine.

The logic circuit control box also includes a display which provides a measurement of the amount of yarn which has passed across the wheel and a three position knob which controls which strokes of the knitting machine are counted. For example, in the first or left position, the device will only measure yarn used in leftward strokes of the carriage. In the right or third position, the device will only measure yarn used in rightward strokes of the carriage. In the center or second position, the device will measure yarn used in both leftward and rightward strokes of the carriage. In this manner, a technician can determine whether or not the leftward stitches are using the same amount of yarn as the rightward stitches by simply comparing the amount of yarn used for the respective directions. If they are not identical, conventional adjustments can be made to shorten or lengthen the stitch size and the test can be run again until equality is reached. This eliminates the guess work involved in determining which stroke of the carriage is creating stitches smaller than the other and facilitates quicker correction and calibration of the knitting machine. The bi-directional count is useful in making sure that this carriage is creating stitches of a size comparable to other machines so that product uniformity is achieved throughout a knitting plant.

In use, the sensor on the carriage starts at the home magnet and is not counting. Assuming the knob is in the center position, the yarn measuring device will begin counting as it passes the first magnet. Since the magnets are preferably one hundred needles apart, the device will measure the amount of yarn used by those one hundred needles. When the carriage passes the second magnet, the sensor will tell the control logic circuit to stop counting. On the return stroke, the sensor will pass the second magnet and begin counting again until it passes the first magnet at which time the device will suspend counting until it passes the first magnet again. This process repeats until one thousand needles have been counted. The logic circuit control box divides the length of yarn measured by the wheel by the one thousand needles and arrives at a stitch size per needle. Since the wheel is providing a digital signal for what is an analog measurement, some error is introduced into the measurement provided by one stroke of the carriage. This error is averaged out by counting more strokes and dividing by a greater number of needles. Other increments rather than one hundred needles or one thousand needles are possible, but these numbers are preferred since they simplify the math required to calculate the per needle stitch size. Similarly, when the knob is in one of the other positions the magnets turn the counting on and off as needed to only count strokes and needles in one direction to arrive at the right stroke stitch size or the left stroke stitch size.

DETAILED DESCRIPTION OF THE PREFERRED EMBODIMENT AND OPERATION OF THE INVENTION

Figure 1:
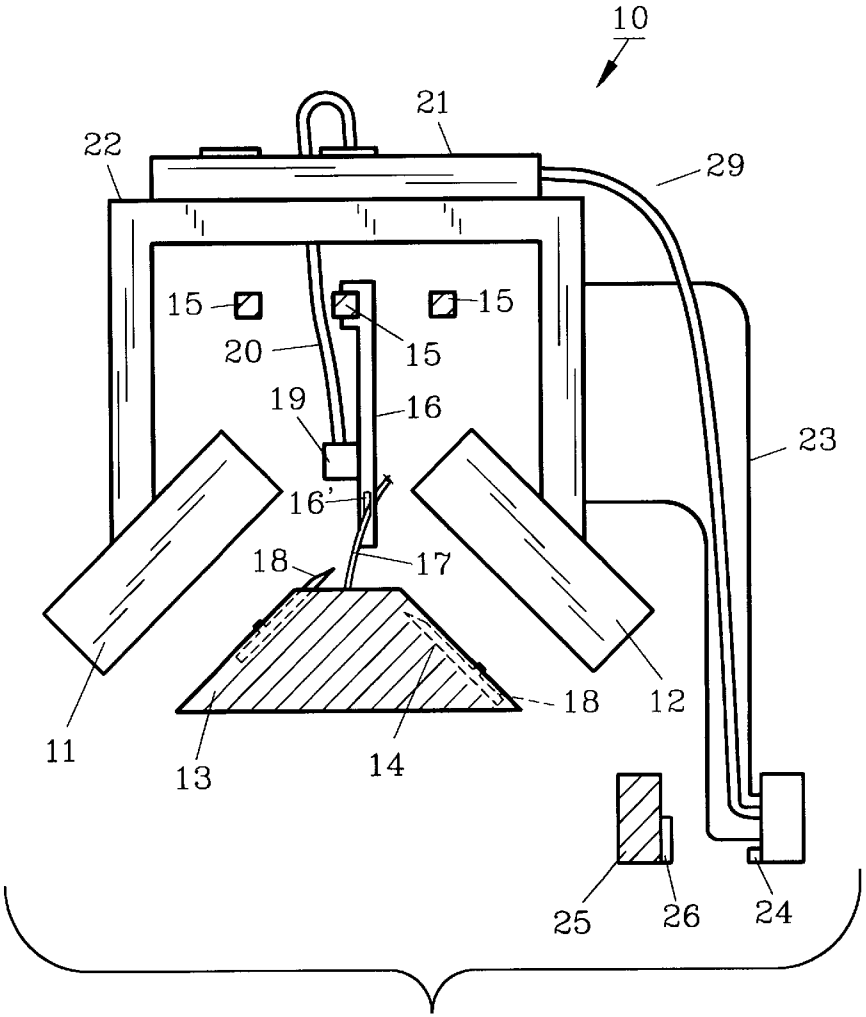
FIG. 1 shows a schematic end view of a conventional carriage of a flat bed needle machine with the device of the present invention attached thereto.

Turning now to the drawings, specifically FIG. 1 shows conventional carriage 10 comprising camming apparati 11 and 12 positioned over needle beds 13 and 14 respectively. While FIG. 1 shows camming apparati 11 and 12 spaced from needle beds 13 and 14, it should be appreciated that the camming mechanisms therein must be in contact with needles 18. Inbetween camming apparati 11 and 12 are plurality of tracks 15. Carrier 16 hangs from one of plurality of tracks 15, while yarn 17 passes through eyelet 16' for knitting by needles 18 in needle beds 13 and 14. All of these parts are conventional, however, carrier 16 has been modified by the placement of wheel 19 thereon, which is preferably nearly identical to the wheel labeled 52 in U.S. Pat. No. 3,790,761, ('761). Cable 20 electrically connects wheel 19 to logic circuit control box 21 positioned preferably on top surface 22 of carriage 10. Yarn 17 passes over wheel 19 as is taught in the '761 patent and, as yarn 17 is knitted, wheel 19 sends an electrical signal to logic circuit control box 21 corresponding to the number of rotations of wheel 19. While the '761 patent discloses a wheel which increments only at complete rotations, advances in photoelectric diodes and LEDs allow the wheel to send incremental signals corresponding to a third, a fifth or smaller rotational increments. Since wheel 19 is preferably one inch (2.54 cm) around, the increments, if evenly spaced, are correspondingly smaller. Thus, signals of one-third or one fifth of an inch increments are possible.

Figure 2:
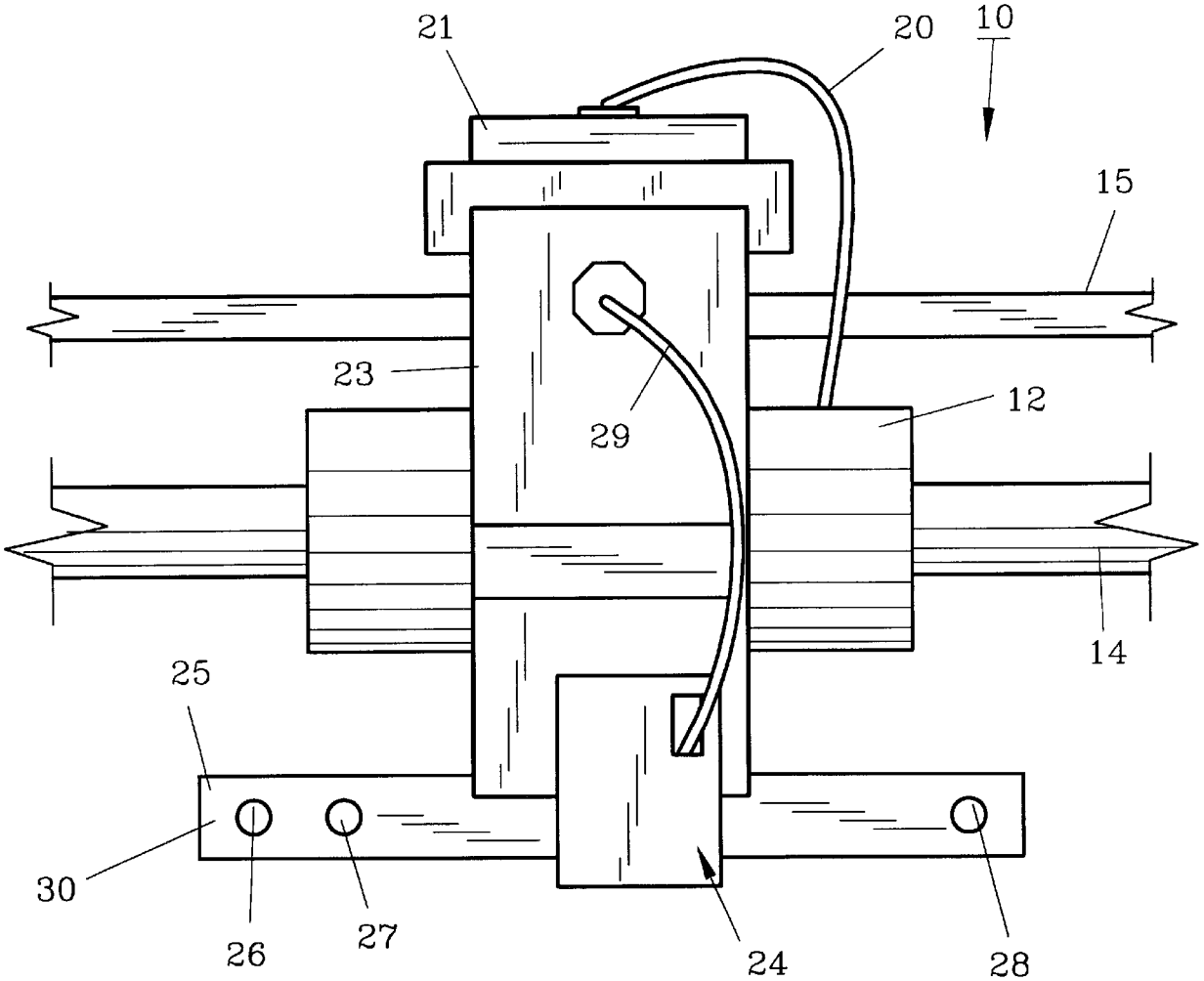
FIG. 2 illustrates a back view of the carriage of FIG. 1 with the magnet bar of the present invention.

Depending from the back of carriage 10 is flange 23. Sensor 24 is positioned thereon proximate bar 25. Sensor 24 may be affixed thereto with conventional double sided adhesive tape or preferably with conventional fasteners such as screws or bolts (none shown). Three round magnets (better seen in FIG. 2) 26–28 are positioned on bar 25. Cable 29 electrically connects sensor 24 to logic circuit control box 21. While not seen, another cable provides power from the knitting machine to logic circuit control box 21 through flange 23. Turning now to FIG. 2, home magnet 26 is positioned proximate end 30 of bar 25 while first magnet 27 is proximate thereto. Second magnet 28 is spaced from first magnet 27 by a distance set according to a the distance required to house a predetermined number of needles within needle beds 13 and 14. For example, on a 12 cut knitting machine, where there are twelve needles per inch, it is preferred that first and second magnets 27 and 28 be spaced apart by approximately 8.3 inches (21.1 cm), which corresponds to one hundred needles. Obviously, on machines where there are more needles per inch, a shorter distance would be required to get one hundred needles. Home magnet 26 is preferably a north pole exposed magnet, while first and second magnets 27 and 28 are preferably south poles exposed magnets.

Figure 3:
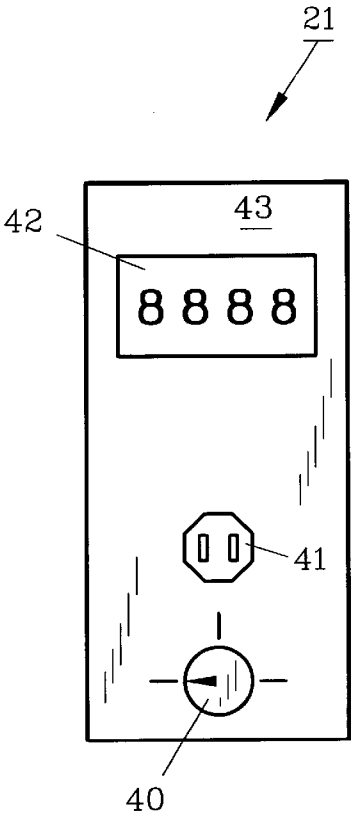
FIG. 3 demonstrates a top view of the logic control box.

As seen in FIG. 3 logic circuit control box 21 is preferably rectilinear and includes three position switch or knob 40, socket 41 and display 42 on top surface 43. Display 42 is preferably a four digit alphanumeric LED panel. Socket 41 is preferably a conventional four conductor socket (only two shown) and allows wheel 19 to be removably electrically connected to box 21 by cable 20. This removable attachment allows carrier 16 with wheel 19 to be used during calibration testing and then replaced with conventional carriers while leaving box 21 and sensor 24 in place as will be explained in more detail below.

Figure 4:
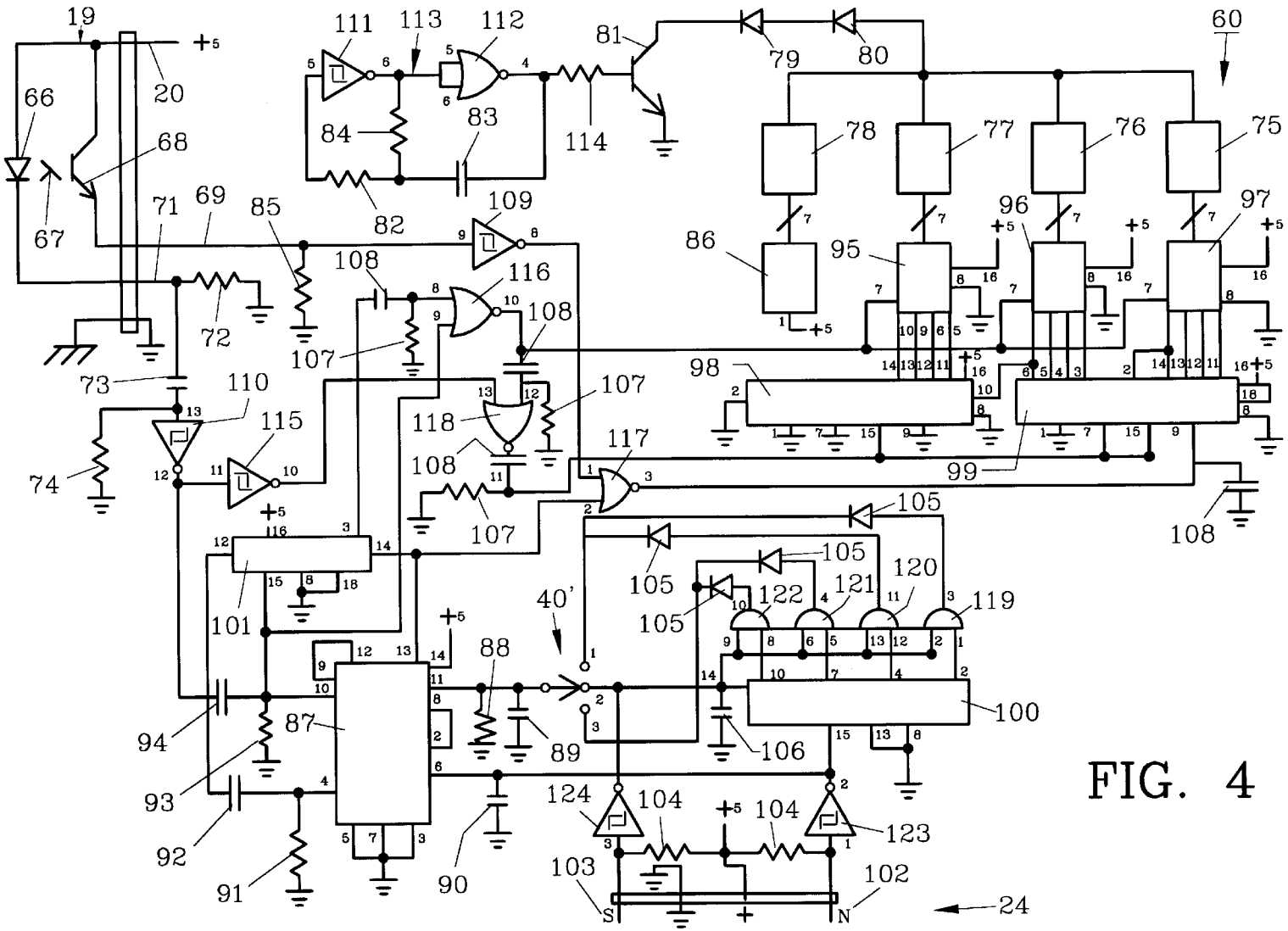
FIG. 4 features an electrical schematic of the logic control circuit contained within the logic control box.
Figure 5:
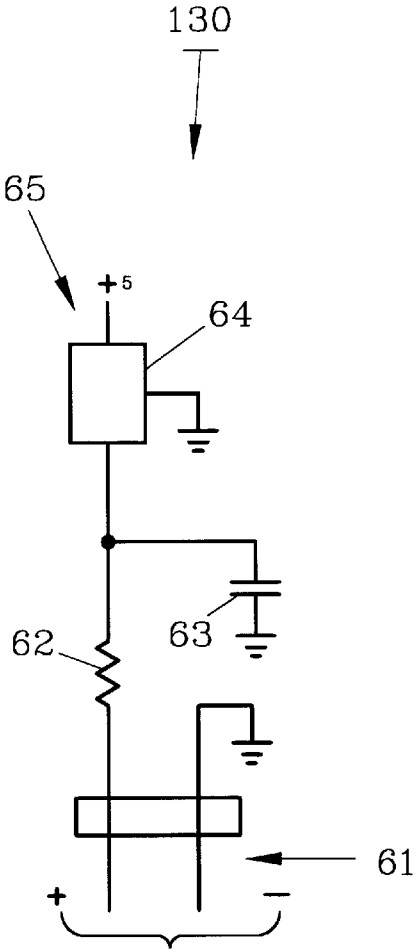
FIG. 5 depicts the power conversion circuit which supplies power to the circuit of FIG. 4.

Logic circuit 60 is seen in FIG. 4, but is contained within box 21 upon a conventional printed circuit board (not shown) as is well understood. Also contained within box 21 is power conversion circuit 130, seen in FIG. 5. Power enters at 24 V (indicated generally at 61) from the knitting machine and is converted to five volts by 150 Ω resistor 62, 220 $\mu$F capacitor 63 and LM340 T5 chip 64 with appropriate connections to ground as indicated. The converted five volts, indicated generally at 65, is used throughout the circuit where indicated by a +5 notation. It should also be understood that on older machines lacking current electrical circuits, it is necessary to use a conventional conversion circuit to convert AC current to the required five volts. Such a substitution would not depart from the spirit of the invention and is well understood.

As also seen in FIG. 4, wheel 19 includes LED 66 which emits light wave 67 towards photoreceptor 68. LED 66 and photoreceptor 68 are preferably sold as a pair by GE under part no. H23B1. The interior wheel (not shown, but explained in the '761 patent) of wheel 19 incrementally allows light wave 67 through spaced apertures to allow detection of increments of rotation as is well understood.

Cable 20 is a four conductor cable which connects to the five volt power supply and ground as well as to various other elements as described below. Cable 20 connects via a conventional connector to wheel 19. The signal from photoreceptor 68 travels along conductor 69 to 10 kΩ resistor 85 and pin 9 of inverter 109. Resistor 85 is preferably a 10 kΩ resistor and connects to ground as indicated. Conductor 71 travels to 300 Ω resistor 72 and 1 $\mu$F capacitor 73 which in turn is connected to 1 MΩ resistor 74 and pin 13 of inverter 110. Diodes 79 and 80 are preferably 1N4003 diodes.

In order to provide a square wave signal to transistor 81 and reduce the current usage of display chips 75–76, free running multi-vibrator 113 is positioned in circuit 60. Multi-vibrator 113 comprises inverter 111, nor gate 112, 1MΩ resistor 82, 0.01 μF capacitor 83, and 100 kΩ resistor 84. Transistor 81 is preferably a 2N3417 transistor, which connects to pin 4 of nor gate 112. This effectively chops the signal traveling through 1 kΩ resistor 114 to transistor 81 and cuts current usage in half as is well understood.

Display chips 75–78 are the LEDs which make up display 42. Each LED 75–78 is connected to a driver, namely drivers 86 and 95–97 by a seven conductor wire. Drivers 95–97 are preferably 14495 conventional drivers which send a conventional A–G signal to display chips 75–77. Chip 78 always displays a zero and a decimal so it has no G-segment on its display, and does not need a dynamic driver so it is connected to 330 Ω SIP 86, which in turn is connected to the five volt power supply. Drivers 95–97 are connected by conventional conductors to 4518 chips 98 and 99 which are counter chips. Pins 11–14 of chip 99 correspond to the least significant digit, while pin 14 couples to pin 2 of chip 99 to provide a carryover counting effect as is well understood. Pins 3–6 count the next least significant digit, while pin 6 is coupled to pin 10 of chip 98. Chip 98 keeps track of the most significant digit.

Inverters 109, 110 and 115, together with nor gates 116–118 provide the gating required to properly count which stroke of carriage 10 is counted and will be explained in greater detail below.

Knob 40 (FIG. 3) corresponds to switch 40' which connects to 4013 flip-flop chip 87 and to 5.6 kΩ resistor 88 and 0.01 μF capacitor 89. Chip 87 also connects to 0.01 μF capacitor 90, 100 kΩ resistors 91, 93 and 0.01 μF capacitors 92, 94. Chips 100 and 101 are both preferably 4017 decade counter chips. And gates 119–122 are preferably all mounted on a single 4081 chip and help control switch 40'.

Sensor 24 is preferably two conventional Hall Effect Switches, such as that sold under part name A3142EU by Allegro, and comprises first device 102, which detects the north magnet and second device 103, which detects the south magnet. Two 5.6 kΩ resistors 104 are positioned on the circuit board separated by cable 29 (FIGS. 1 and 2) and a conventional connector. Diodes 105 are 1N4148 diodes preferably. Capacitors 106 and 108 (4) are preferably 0.01 μF capacitors. Resistors 107 (3) are preferably 100 kΩ resistors. Inverters 123 and 124 are used to control the signals sent to switch 40' and chips 87 and 100. It should be understood that all inverters and NOR gates are preferably mounted on a single chip, but were broken up for simplicity in explaining the above described circuit.

As described and shown, circuit 60 performs the following functions, switch 40' controls when sensor 24 biases flip-flop 87 and decade counters 100 and 101 to allow the signal from wheel 19, and photoreceptor 68 specifically, to reach the first counter in chip 99 through NOR gate 117. When the signal passes through NOR gate 117 the least significant digit counter in chip 99 increments with carry over to the increasingly significant digits of chips 99 and 98. While these counters are incrementing, drivers 95–97 are latched and no signal passes from chips 98, 99 to drivers 95–97. When the count is complete, clock pins 7 of drivers 95–97 are activated by the output of NOR gate 116 and drivers 95–97 then accept input from counters 98 and 99. Drivers 95–97 then latch and counters 98 and 99 are reset by the output of NOR gate 118 through pins 7 and 15 as needed of counters 98 and 99. Thus, while photoreceptor 68 provides a continuous square wave signal through inverter 109 NOR gate 117 precludes it from going to counter 99 unless carriage 10 is on the proper stroke as determined by switch 40', flip-flop 87, and decade counters 100 and 101. The output of decade counter 101, which is the final control for NOR gate 117, is controlled by sensor 24's input to flip-flop 87 and decade counter 100, depending on the position of switch 40'.

It should also be appreciated that sensor 24 and magnets 26–28 are not the only way to register the number of needles that have been passed. While not shown, other possibilities include a photoelectric sensor which could count the discontinuities representing the needle slots (not shown) within needle beds 13 and 14. Another possibility is for an electromechanical feeler gauge to physically register the same needle slots with a counter emitting an appropriate signal when 100 ticks of the feeler have been registered. While not preferred, these provide further options as means to effectively count a predetermined number of needles in order to gate the signal from photoreceptor 68.

In use, carriage 10 travels on a track (not shown) the length of the knitting machine. The technician inserts a number of needles 18 into needle beds 13 and 14 corresponding to the desired length of the collar to be created. This number is almost never less than 100 needles per side, since even small children collars require 100 needles or more. Magnet bar 25, sensor 24 and logic circuit control box 21 are prepositioned on carriage 10 and under needle beds 13 and 14 as indicated above. The preferred positions discussed above are preferred for the NOVA Z-series flat bed knitting machines. It should be understood that various clearances, sizes and the like may necessitate the repositioning of these elements without changing the spirit of the invention. All conventional carriers (none shown) are removed and replaced by a single modified carrier 16 complete with wheel 19. Yarn 17 is fed over and engages wheel 19 for measurement thereof. The knitting machine is turned on as is conventional and carriage 10 grabs carrier 16, again as is conventional. As carriage 10 moves back and forth over the length needle beds 13 and 14, needles 18 are forced upwardly within needle beds 13 and 14 by camming apparati 11 and 12 respectively to knit yarn 17 into fabric, typically for use as a collar. Yarn 17 turns wheel 19 which is preferably one inch in circumference. While the device in the '761 patent could only increment in one inch increments, finer resolution may be achieved by increasing the number of slots—within the interior wheel (not shown) of wheel 19—which trigger pulses from LED 66 and photoreceptor 68 contained therein as disclosed in my earlier '761 patent. While three slots are presently preferred, finer resolution is always desirable and five slots or more are certainly possible. Photoreceptor 68 within wheel 19 sends a signal via cable 20 to logic circuit control box 21.

Simultaneously, sensor 24 begins positioned proximate home magnet 26, which sends a signal via cable 29 to logic circuit control box 21. The present example will assume that knob 40 is in the center position Carriage 10 will move from left to right down needle beds 13 and 14. When sensor 24 passes over first magnet 27, sensor 24 will send a signal to logic circuit control box 21, specifically flip-flop 87 which opens input from wheel 19 and starts incrementing counter 99 based on the number of rotations of wheel 19. When, carriage 10 passes second magnet 28, sensor 24 attached to carriage 10 sends another signal to logic circuit 60, specifically flip-flop 87 which closes the input from wheel 19. Decade counter 101 increments to show that one pass has been performed. Since magnets 27 and 28 are one hundred needles apart, the number of rotations of wheel 19 equals the amount of yarn used by those one hundred needles, plus or minus the distance between apertures of the wheel. For greater accuracy, it is preferred to divide a yarn length used by one thousand needles, so on the right to left stroke of carriage 10, sensor 24 instructs circuit 60 to count again as sensor 24 passes second magnet 28. The counting stops when sensor 24 reaches first magnet 27. Now two hundred needles have been counted and the yarn used by those two hundred needles is stored. This process repeats until ten total passes, corresponding to one thousand needles have been counted and the yarn measured. While it is possible to actually perform the math to calculate the stitch size per needle, with one thousand needles, all that has to be done is shift the decimal over three places to reach the average stitch size.

Similarly, the above process may be performed in only one direction. For example, if knob 40 is in the left position, only needles used on a left to right stroke are counted. Or if knob 40 is in the right position, only needles on a right to left stroke are counted. In order to prevent curling of the finished collar, these two stitch sizes need to be equal. Once the stitch sizes of each direction are known, conventional camming adjustments can be made to camming apparati 11 and 12 to equalize the scan be done and matchtional stitch size test can be done and matched to other machines similarly calibrated so that all machines are producing uniform collars. Upon proper calibration of the knitting machine, carrier 16 is removed by disconnecting cable 20 and removing it from track 15. Then, the non-modified carriers are replaced in order to properly knit the desired collars.

The preceding recitation is provided as an example of the preferred embodiment and is not meant to limit the nature of scope of the present invention or appended claims.

I claim:

1. In a flat bed knitting machine comprising a needle bed and at least one carriage positioned proximate said needle bed, said carriage comprising a carrier, said carrier dispensing yarn to said needle bed for knitting, the improvement comprising:

means for measuring the amount of yarn passing through said carrier, said measuring means positioned on said carrier, a bar, three signal devices, said signal devices positioned on said bar proximate said carriage.

2. The flat bed knitting machine of claim 1 further comprising a logic circuit, said logic circuit electrically connected to said measuring means.

3. The flat bed knitting machine of claim 1 further comprising a logic circuit control box and a connector, said connector attached to said measuring means and said logic circuit control box.

4. The flat bed knitting machine of claim 1 further comprising a sensor, said sensor positioned on said carriage, said sensor for detecting signals from said signal devices.

5. The flat bed knitting machine of claim 4 further comprising a control knob, said control knob positioned on said logic circuit control box.

6. A method of calculating stitch size on a flat bed knitting machine, said method comprising the step of:

a) positioning means for measuring yarn on the carrier of the flat bed knitting machine;

b) measuring the yarn used as the carriage of the flat bed knitting machine passes over a known number of needles;

c) dividing the amount of yarn used by the number of needles passed over; and d) positioning a series of signal devices a fixed distance apart on the knitting machine wherein said fixed distance corresponds to a known number of needles.

7. The method of claim 1 further comprising the step of passing a sensor over said series of signals to start and stop measuring the amount of yarn used.

8. The method of claim 6 wherein dividing the amount of yarn used by the number of needles passed over comprises the step of using a logic circuit to divide the amount of yarn used by the number of needles passed over.

9. The method of claim 6 wherein measuring the yarn used as the carriage of the flat bed knitting machine passes over a known number of needles comprises the step of making multiple passes over the needle bed.

10. The method of claim 6 measuring the yarn used as the carriage of the flat bed knitting machine passes over a known number of needles comprises the step of passing the carriage over one hundred needles.

11. In a flat bed knitting machine comprising a needle bed and at least one carriage positioned proximate said needle bed, said carriage comprising a carrier, said carrier dispensing yarn to said needle bed for knitting, said needle bed creating stitches with measurable size, the improvement comprising: a device for calculating the stitch size created by said needle bed, said device comprising:

a) a logic control circuit;

b) a wheel, said wheel tensioned by said yarn and turning as yarn passes thereover, said wheel further comprising means to calculate the number of rotations of said wheel to effectively measure the amount of yarn passing thereover, said wheel electrically connected to said logic control circuit;

c) a plurality of magnets, said magnets positioned proximate said carriage; and d) a sensor, said sensor capable of detecting said plurality of magnets, said sensor proximate said magnets, and said sensor electrically connected to said logic control circuit.

12. The knitting machine of claim 11 further comprising a logic circuit control box, said logic control circuit positioned within said logic circuit control box.

13. The knitting machine of claim 12 further comprising a three position switch, said switch positioned on said box.

14. The knitting machine of claim 12 further comprising a display, said display positioned on said box.

15. The knitting machine of claim 11 further comprising a linear bar, said magnets positioned on said linear bar, said linear bar positioned on said knitting machine beneath said carriage.

16. The knitting machine of claim 11 wherein two of said plurality of magnets are spaced apart by the distance corresponding to one hundred needles on the needle bed.

17. In a flat bed knitting machine comprising a needle bed and at least one carriage positioned proximate said needle bed, said carriage comprising a carrier, said carrier dispensing yarn to said needle bed for knitting, the improvement comprising:

means for measuring the amount of yarn passing through said carrier, said measuring means positioned on said carrier, a bar, a plurality of signal devices, said signal devices positioned on said bar proximate said carriage.

18. The improvement of claim 17, wherein said plurality of signal devices comprise three signal devices.

* * * * *

UNITED STATES PATENT AND TRADEMARK OFFICE

CERTIFICATE OF CORRECTION

PATENT NO. : 6,112,557
DATED : 05 September 2000
INVENTOR(S) : Charles R. Crabtree It is certified that error appears in the above-identified patent and that said Letters Patent is hereby corrected as shown below:

Column 7, line 25, delete "scan be done and matchtional" and insert therefor -- same. Then, a bi-directional --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*